US005162665A

United States Patent [19]

Troyen

[11] Patent Number: 5,162,665

[45] Date of Patent: Nov. 10, 1992

[54] ELEVATOR CALL BUTTON/ANNUNCIATOR ASSEMBLY AND CIRCUIT

[76] Inventor: Steven Troyen, 1530 Stevens St., Philadelphia, Pa. 19149

[21] Appl. No.: 496,966

[22] Filed: Mar. 21, 1990

[51] Int. Cl.[5] ..... B66B 1/14; B66B 3/00; H01H 9/16; H05B 39/00

[52] U.S. Cl. ..... 307/112; 187/130; 200/314; 315/76; 315/276; 315/291; 340/815.13

[58] Field of Search ..... 187/121, 129, 130; 315/224, 276, 291, 209 R, 76; 116/64; 200/314; 307/31, 112, 116, 119, 134, 135, 632; 340/332, 333, 815.12, 815.13, 815.15, 815.17; 323/324, 327; 361/166-169.1, 189, 190

[56] References Cited

U.S. PATENT DOCUMENTS

| | | | |
|---|---|---|---|
| 3,774,728 | 11/1973 | Metzler et al. | 187/29 R |
| 3,875,554 | 4/1975 | Booker, Jr. et al. | 315/307 X |
| 4,126,849 | 11/1978 | Mente et al. | 340/332 X |
| 4,144,477 | 3/1979 | Eaton | 315/276 |
| 4,447,765 | 5/1984 | Cote | 315/240 |
| 4,506,318 | 3/1985 | Nilssen | 363/132 |
| 4,725,759 | 2/1988 | Tachikawa | 315/51 |
| 4,785,916 | 11/1988 | Jaster | 187/121 |

OTHER PUBLICATIONS

Sylvania/GTE, *Lighting Handbook, 7th ed.*, 1984, p. 51.

*Primary Examiner*—Howard L. Williams
*Assistant Examiner*—David Osborn
*Attorney, Agent, or Firm*—Harvey D. Fried

[57] ABSTRACT

A vibration-resistant elevator call button/annunciator assembly comprises: a switch housing defining an interior cavity and apertures opening into the cavity; a switch mounted in the housing; a switch actuating member movably disposed in the cavity; a resilient member for urging the actuating member into an unactuated position in the cavity; and, a light module for illuminating the actuating member mounted through a wall of the housing. The light module preferbly snap fits in an aperture in the housing, the wedge-based lamp being press fitted into a receptacle in the module. An electrical circuit for utilizing the modular assembly as an elevator call button/annunciator assembly comprises: a voltage stepdown transformer having a primary winding adapted for coupling to an AC mains supply and having a secondary winding for developing an output voltage at a first level; a switch coupled to the secondary winding; and, a lamp mounted in a switch housing and coupled to the switch for illuminating a call button/annunciator responsive to actuation of the switch, the lamp having a voltage rating greater than the first level. The switch may be actuated by engagement of the call button. The lamp may be a T-3 ¼ wedge-based lamp, having a voltage rating greater than the output voltage lelvel.

16 Claims, 5 Drawing Sheets 12
18
20
16
14
50
59
52
53
57
55
54
34
44
60
62
56
57
52
53
42
66
68
72
70
104
82
90
84
86
100
98
96
102
36
114
40
22
110
112
92
93
76
78
80
72
88
32
38

ELEVATOR CALL BUTTON/ANNUNCIATOR ASSEMBLY AND CIRCUIT

BACKGROUND OF THE INVENTION

1. Field of the Invention

This invention relates generally to the field of elevator controls, and in particular, to illuminated call button and/or annunciator assemblies and circuits for elevators, which are subject to vibration during operation.

2. Description of Art

Switches and circuits for elevator controls can experience premature failure due to the vibration which is inherent in elevator operation. Switches and circuits for elevator controls can also experience premature failure due to the repeated mechanical stresses and the repetitive surge currents which develop as the call buttons, for example, are pressed and even sometimes punched, on a daily basis. Call buttons are deemed to include those buttons which are mounted outside the elevator doors, adjacent thereto, as well as those in the elevator cabs. When lighted indicators are required, but without a switching capacity, it is customary to use a call button assembly with a lamp but without switches. Such indicators are referred to as annunciators. Hereinafter reference will be made generally to call button/annunciator assemblies as encompassing all of these variations of the elevator call button.

Call button/annunciator assemblies have been constructed with smaller and smaller components over the years, following the general trend in electronics towards miniaturization. Smaller and smaller switch assemblies have been developed, which can result in lower costs of manufacture. Unfortunately, such smaller switch assemblies, particularly illuminated switch assemblies, are less resistant to the wear and tear of the vibration and the mechanical and electrical stresses.

Although some savings can be realized in cost and manufacture, the cost saving is illusory. As a practical matter, a service call by a trained technician is necessary to change a lamp in a call button/annunciator assembly. Even if the cost of the miniature or subminiature lamp, for example $1.50, is discounted altogether, the minimum charge for such a service call can be Fifty to Seventy dollars, on average.

Construction practices in the industry been undertaken which have reduced the initial cost of call button/annunciator assemblies by utilizing lamps which can be coupled directly to an AC mains source, albeit through one or more switches. This substantially increases the premature aging effects of surge currents each time the lamp is lit, particularly in high voltage installations, for example those over 60 volts, which constitute the majority of all installations. The effects of surge currents further reduce the operational lifetime of the lamp, necessitating more service calls. Tungsten filaments in lamps are subject to a phenomenon known as notching, which is the appearance of step-like or sawtooth irregularities, on all or part of the tungsten filament surface. The phenomenon is more pronounced in smaller lamps, which are manufactured with thinner filaments. Thinner filaments are also more prone to damage from mechanical stress or shock. Experience has shown that lamps are the weakest link in the maintenance chain from elevator call button/annuciator assemblies. Indicator assemblies employing neon lamps and light emitting diodes have proven unsatisfactory, being too dim and being incapable of emitting white light.

This invention deals with the real problem plaguing call button/annunciator assemblies for elevators, which is not reducing the initial cost of manufacture, but significantly extending the operational lifetime of such assemblies by reducing the frequency of service calls needed to change burned out lamps. Several measures are taught herein to extend the operational lifetime of lamps in elevator call button/annunciator assemblies. When these measures are undertaken, the operational lifetime of a lamp can be increased from a range of eight months to one year to a range of three to five years.

Firstly, these measures include the use of wedge-based lamps, which have been proven reliable in vibration environments in other fields. Secondly these measures include the use of larger lamps having larger and thicker filaments, which are less prone to notching or other damage from surge currents or mechanical stresses. Thirdly, these measures include incurring the added cost of a transformer for driving each lamp at a significantly lower than AC mains voltage level, and to enable use of a lamp which is rated for a higher voltage than the secondary output of the transformer, but lower than the AC mains voltage. As an example, a 120 volt mains supply, which would otherwise energized a lamp directly, is stepped down to a 24 volt secondary supply voltage by the transformer to drive a wedge-based lamp rated for operation at 28 volts. Fourthly, these measures include a modular push-button assembly for implementing an elevator call button/annunciator assembly, which is adapted to accommodate a larger bulb without significantly increasing the size of the assembly housing and to streamline production.

SUMMARY OF THE INVENTION

It is an aspect of the invention to provide a vibration-resistant elevator call button/annunciator assembly requiring significantly fewer service calls to replace burned out lamps. A vibration-resistant elevator call button/annunciator assembly in accordance with this aspect of the invention comprises: a switch housing defining an interior cavity and apertures opening into the cavity; a switch mounted in the housing; a switch actuating member movably disposed in the cavity; resilient means for urging the actuating member into an unactuated position in the cavity; and, a light module for illuminating the actuating member mounted through a wall of the housing, the light module including a wedge-based lamp. The light module preferably snap fits in an aperture in the housing, the wedge-based lamp being press fitted into a receptacle in the module. Advantageously, the lamp is a T-3¼ wedge-based lamp.

It is another aspect of the invention to provide an electrical circuit for an elevator call button/annunciator assembly which enhances the operational lifetime of the lamp provided therein. An electrical circuit for an elevator call button/annunciator assembly in accordance with this aspect of the invention comprises: a voltage stepdown transformer having a primary winding adapted for coupling to an AC mains supply and having a secondary winding for developing an output voltage at a first level; a switch coupled to the secondary winding; and, a wedge-based lamp mounted in a switch housing and coupled to the switch for illuminating a call button/annunciator responsive to actuation of the switch, the lamp having a voltage rating greater than the first level. The switch may be actuated by engagement of the call button. Advantageously, the lamp is a T-3¼ wedge-based lamp. The lamp preferably has a voltage rating greater than the output voltage level of the secondary winding of the transformer. Other components, particularly solid state switching devices, can be used in place of the relays and transformers.

It is yet another aspect of the invention to provide a modular switch assembly for implementing an elevator call button/annunciator assembly, which is adapted to utilize a larger than normal indicating lamp, for example one over ⅜ inches in diameter. The most common sizes of lamps for elevator call button/annunciator assemblies is T-1¾ and T-2. The numerical part of the bulb designation represents the bulb diameter in total number of ⅛ inch increments. A modular push-button assembly in accordance with this aspect of the invention comprises: a body defining an interior cavity and apertures opening into the cavity; a first actuating member disposed in the cavity and partly projecting into one of the apertures; at least one self-contained switch assembly mounted on the body and having a second actuating member projecting into the cavity and engageable by the first actuating member, the self-contained switch assembly having resilient means for urging the first and second actuating members into unactuated positions in the cavity; and, a self-contained light assembly for illuminating the first actuating member mounted on the body through another of the apertures. The body may comprise first and second plate-like members held in spaced relationship by at least two spacers, the spacers limiting lateral movement of the first actuating member out from between the first and second plate-like members. The first actuating member may also be plate-like, having lateral edges defining grooves for slideably abutting the spacers during movement between the first and second plate-like members. Advantageously, the first actuating member has a portion projecting into another of the apertures in the body and the light assembly comprises a lamp projecting into the projecting portion of the actuating member.

These and other aspects of the invention will be apparent to those skilled in the art from the following detailed description of the preferred embodiments of the invention and the drawings.

DETAILED DESCRIPTION OF THE PREFERRED EMBODIMENTS

Figure 1:
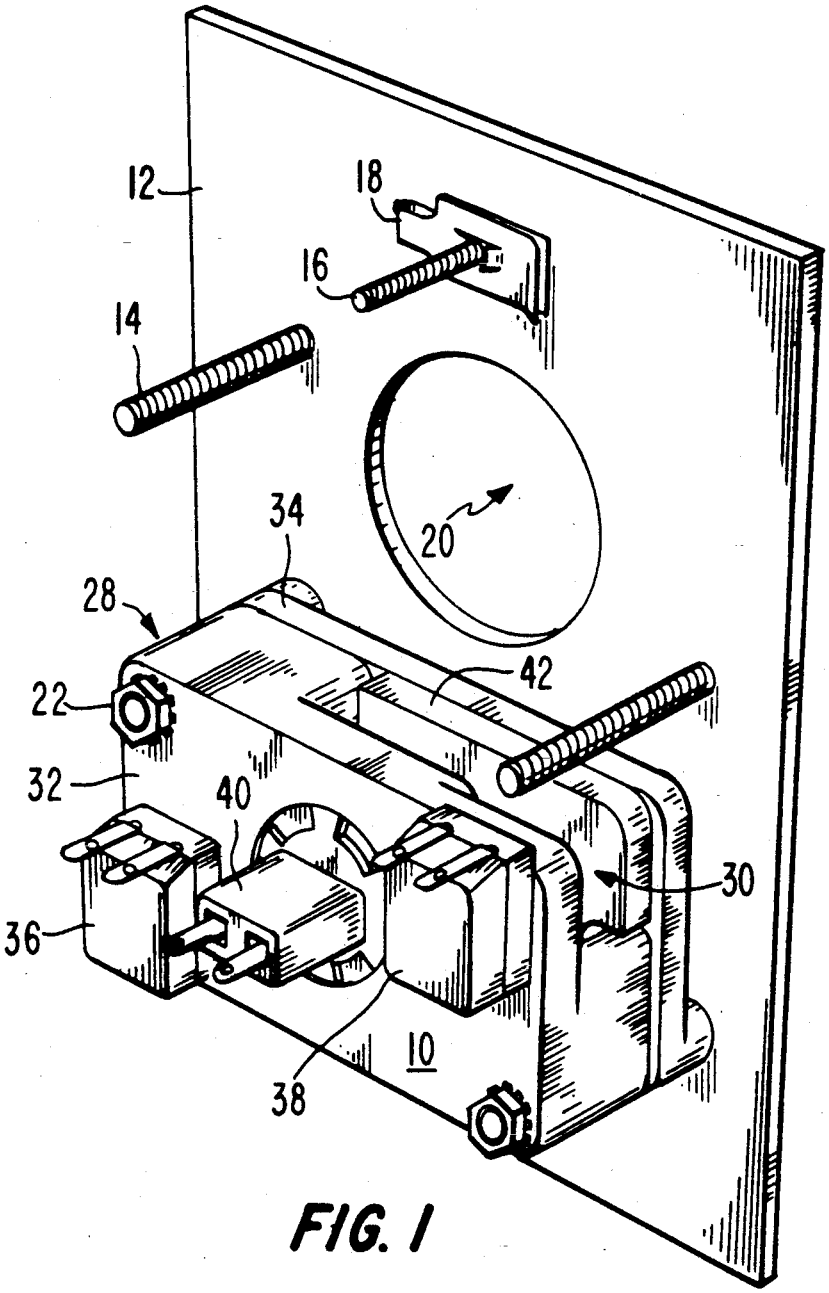
FIG. 1 is a perspective view of a modular push-button assembly according to this invention, embodied as an elevator call button/annuciator, and mounted on a wall plate.

A modular push-button assembly in accordance with an aspect of this invention is shown in FIG. 1 and generally designated by reference numeral 10. The push-button assembly 10 may be mounted on a wall plate 12 by means of threaded studs 14 and nut/lock washer assemblies 22. The wall plate 12 may be secured by machine screws 16 and clips 18. Clips 18 may be attached, for example, to tabs on an enclosure box. The wall plate 12 has apertures 20 for accessing the push-button associated with each push-button assembly. When embodied as a modular elevator call button/annunciator assembly, each wall plate may be provided with a plurality of such assemblies, for example an UP and a DOWN button assembly.

Each modular push-button assembly comprises a body 28 defining an interior cavity 30. Each body 28 comprises a first plate like member 32 and a second plate like member 34. A first actuating member 42 is disposed in the cavity 30 and adapted for reciprocal movement therein. A first self-contained switch assembly 36 and a second self-contained switch assembly 38 are mounted through apertures in the plate like member 32. A self-contained light assembly 40 is also mounted through an aperture in plate like member 32. Resilient means, for example springs 106, in the self-contained switch assemblies (shown in FIG. 3) urge the first actuating member 42 into an unactuated position in the cavity.

Figure 2:
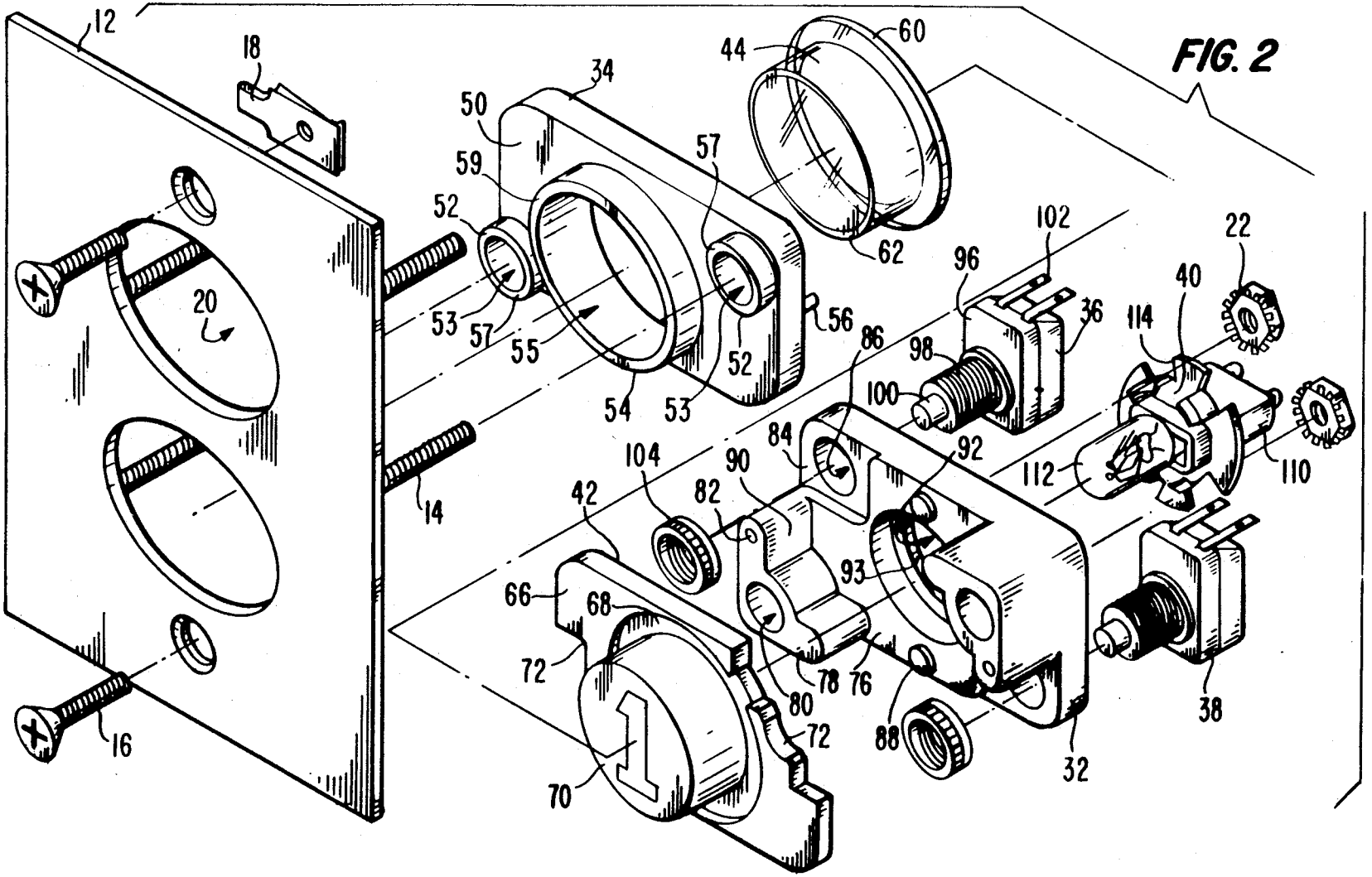
FIG. 2 is an exploded view of the push-button assembly shown in FIG. 1.

The detailed structure of the modular push-button assembly is shown more fully in the exploded view of FIG. 2. Plate like member 34 has a central aperture 55 surrounded by a bezel or cylindrical rim 54 projecting from exterior surface 50. Two further apertures 53 are surrounded by bezels or cylindrical rims 52 projecting from surface 50. Bezel 54 is adapted to closely fit through aperture 20 in wall plate 12, with the edge 59 of the bezel substantially flush with the front surface of the wall plate. Apertures 53 are adapted for receiving the threaded mounting studs 14. The edges 57 of the bezels 52 are adapted to abut the rear surface of the wall plate 12 and provide a wobble free seating of the push-button assembly when the lock nuts are tightened, preferably substantially equally. Two positioning pins 56 project from the interior surface and engage bores 82 in plate like member 32. The pins and bores may also act by friction to enable preassembly of the modular push button/annunciator assembly prior to attachment to a wall plate or the like. The apertures 53 and 82 and pins 56 are preferably symmetric about the axial center of aperture 55.

First actuating member 42 has a projection 70, cylindrical in the illustrated embodiment, surrounded by an recess 68 of like configuration, in the surface 66. A clear cover 44 may be provided, having a cylindrical part 62 and an annular base 60 is adapted to over fit the first actuating member 42, with the annular base 60 resting in the annular recess 68. The clear cover imparts a shiny finish to the actuating member and protects indicia on the face of the actuating member. Such indicia, for example a floor number, may be hot stampings, decals and the like. The cover and cylindrical part 70 extend through apertures 55 and 20. The exposed cover 62 is adapted to be manually pressed. First actuating member 42 is also provided with shaped guide surfaces, for example multiple arcuate surfaces 72, for retaining the actuating member within the cavity during movement thereof. The multiple arcuate surfaces are preferably symmetric about the axial center of cylindrical part 70. Surfaces 72 slideably abut corresponding surfaces 90 in the plate like member 32.

It will be appreciated that many of the components shown as being cylindrical in shape need not be so. The shape of the outer surface of bezel 54 must correspond to the shape of aperture 20 in plate 12. The shape of the projection 70 must correspond to the inner shape of bezel 54. However, the inner and outer shapes of bezel 54 can differ from one another. The slideably abutting surfaces 72 and 90 must correspond to one another, but need not be multiple arcuate surfaces as shown. It is an aspect of the invention to provide considerable leeway in aesthetic design without compromising the mechanical and electrical advantages of the invention.

Plate like member 32 has an interior surface 76 and an aperture 92. Aperture 92 is axially aligned with cylindrical part 70, cover 44 and aperture 55. Two diagonally opposite spacers 78 are formed integrally with plate like member 32 to form the cavity 30. Each spacer comprises an aperture 80, a bore 82 and a multiple arcuate surface 90. The apertures 80 are positioned to receive the mounting studs 14. The bores 82 are adapted to receive the positioning pins 56. The surfaces 90 are adapted to slideably engage surfaces 72, holding the actuating member 42 within the cavity during movement thereof. Lugs 88 project from surface 76 to limit rearward movement of the actuating member 42 protecting bulbs and contacts from bottoming out damage. Adjustable stops may be provided, for example, by nut/bolt/lock washer assemblies mounted in apertures at the positions of the lugs. Two diagonally opposite recesses 84 have apertures 86 therethrough. Apertures 86 are adapted to receive self-contained switch assemblies 36 and 38. The spacers 78, the apertures 86 and the lugs 88 are each preferably symmetric about the axial center of aperture 92.

Figure 3:
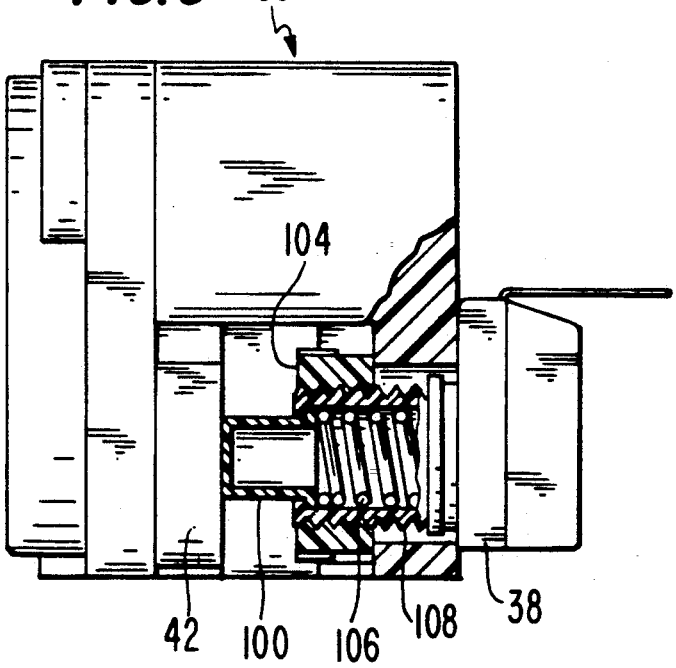
FIG. 3 is a side elevation of the push-button assembly shown in FIG. 1, partially cut away to illustrate the internal spring of a self contained switch assembly.

Each of the self-contained switch assemblies 36 and 38 has a threaded stem 108 as shown in FIG. 3. Each has a second actuating member 100 slideably disposed in the stem. Each actuating member 100 is urged into an unactuated position by resilient means, for example spring 106. Each of the self-contained switches is secured to the plate like member 32 by nuts 104, which are disposed at least partly in recesses 84. The switch assemblies 36 and 38 are provided with electrical contacts 102. The switches may be of any type, for example, momentary or maintained, normally open or normally closed, or single or multiple poled, as necessary. The resilient means urge both the first and second actuating members into unactuated positions, obviating the need for separate biasing means for the first actuating member. The large number of cooperating surfaces and the symmetric construction assure that the first actuating member 42 will remain substantially parallel to the plate like members 32 and 34 throughout its range of movement, assuring reliable operation, even if the button (cover 44) is pressed off axis.

Figure 5:
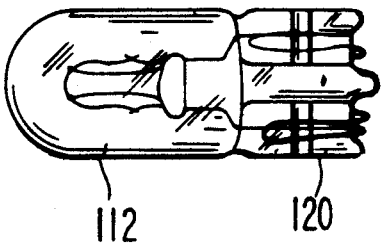
FIG. 5 is a side elevation of a wedge based lamp adapted for mounting in the receptacle shown in FIG. 4.
Figure 4:
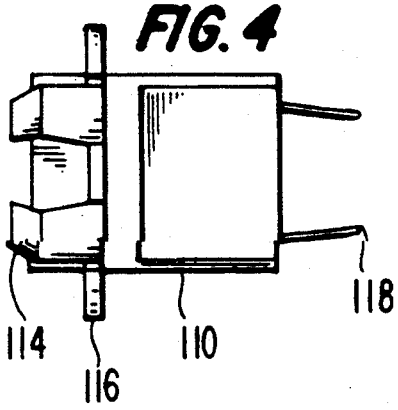
FIG. 4 is a side elevation, in enlarged scale, of a receptacle for a wedge based lamp.

The self-contained light assembly 40 comprises a receptacle 110 and a lamp 112 as shown in FIGS. 4 and 5. The receptacle 110 is preferably a rear mount receptacle, and may comprise resilient mounting fingers 114 and flange 116 which cooperate with one another to enable the receptacle to be snap fitted into aperture 92, engaging an inwardly directed flange 93 of reduced thickness. The flange 93 simulates the edge of a mounting opening in a sheet metal member, and enables a wide variety of snap mountable lamp receptacles to be utilized, including those with spring arms and those which are secured by twisting after insertion. The receptacle also has terminals 118. The lamp 112 is advantageously provided with a wedge shaped base 120, which is particularly resistant to vibration, an environmental hazard in elevator installations. Wedge based lamps of the sizes T-3¼ and larger, for example T-5, are in accordance with an aspect of this invention, and are available from a number of manufacturers.

The various components of the modular push button assembly are preferably made from plastics material, by an injection molding process. This is so even for the part receiving the lamp receptacle. It is particularly advantageous to utilize a plastics molded part to mount lamp receptacles intended for mounting in sheet metal cutouts, perforations and the like.

Figure 6:
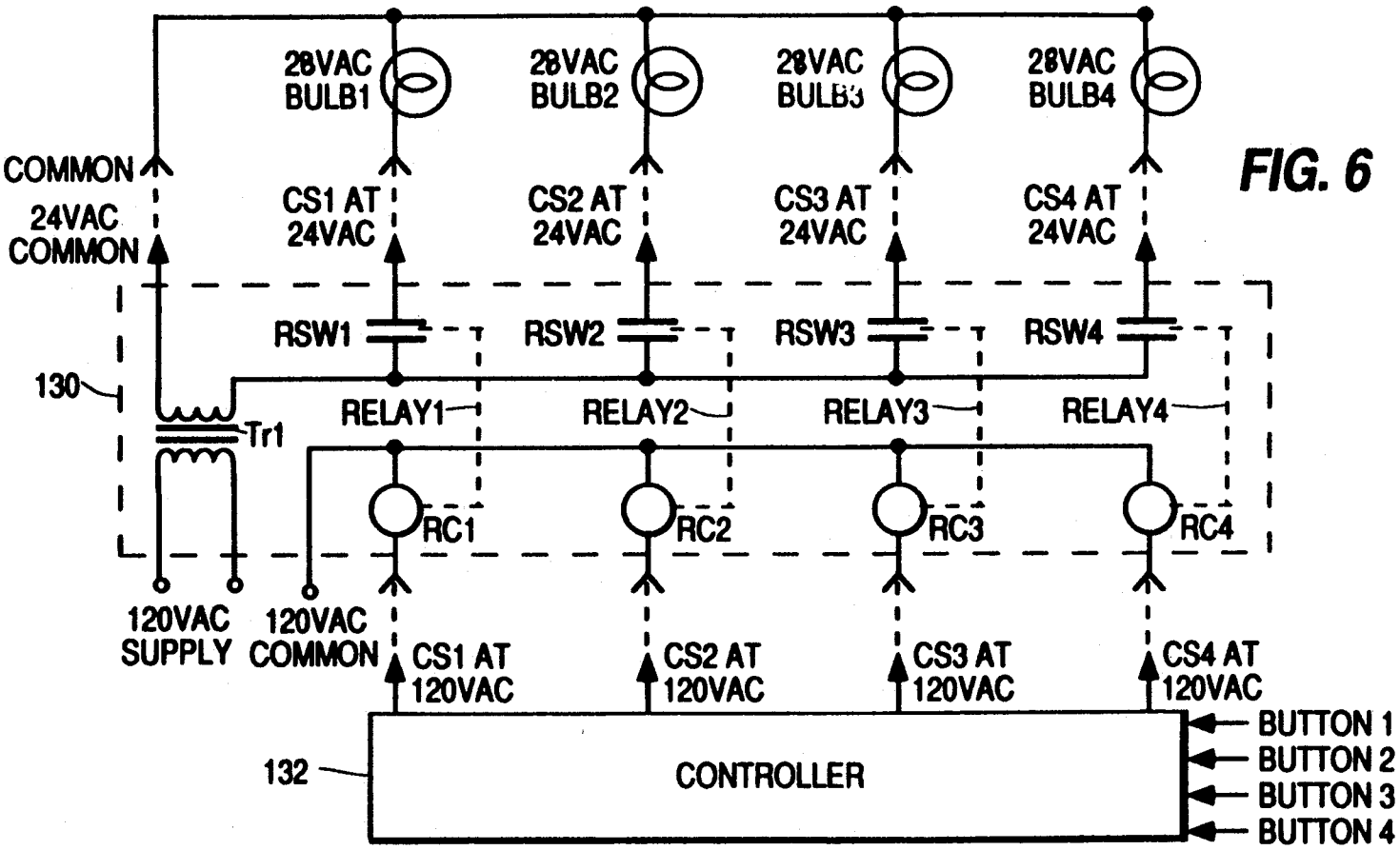
FIG. 6 is a circuit schematic, employing relays and transformers, for utilizing push-button assemblies as shown in FIG. 1 as elevator call button/annunciator assemblies.

An illustrative circuit for an elevator call button/annunciator assembly is shown in FIG. 6. The primary winding of a transformer Tr1 is coupled to an AC mains supply, for example 120 volts (120VAC SUPPLY). Transformer T1 steps down the voltage in a secondary winding to 24 volts AC. One terminal of the secondary winding is available as a 24 volt common line. The other terminal supplies a plurality of relay coils. One terminal of the primary winding may be used as a 120 volt common line, although that line is shown as a separate line. For purposes of illustration, the transformer Tr1 and four relays designated RELAY1, RELAY2, RELAY3 and RELAY4 are shown as a separate assembly 130. Typically, a plurality of such assemblies would be required. Since all of these assemblies can readily be placed in a single location near the controller, which is often located in a machine room without severe space constraints, assembly 130 is particularly suitable as a retrofit circuit for converting an existing elevator control system to one incorporating this invention. Each relay comprises a relay coil, respectively designated RC1, RC2, RC3 and RC4 and a relay switch controlled by the relay coil. The relay switches are respectively designated RSW1, RSW2, RSW3 and RSW4. The coil and switch of each relay is connected by a dashed line.

A controller 132 forms part of the elevator control system, and is responsive to four control buttons, designated BUTTON1, BUTTON2, BUTTON3 and BUTTON4. A button press from any of the buttons will result in the generation of a control signal for lighting one of four indicator lamps, designated BULB1, BULB2, BULB3 and BULB4. The control signals are at the mains voltage, 120 volts AC as illustrated. The control signals are designated CS1, CS2, CS3 and CS4. In a conventional system, the bulbs are rated for operation at the mains voltage, 120 volts AC as illustrated. When modified in accordance with aspects of this invention, the control signals CS1–CS4 operate respective relays RELAY1–RELAY4 by energizing respective coils RC1–RC4. Energization of the coils causes respective switches RSW1–RSW4 to be closed, transforming the control signals from the mains supply voltage to the output voltage level of the secondary winding of transformer Tr1, 24 volts AC. Bulbs BULB-1–BULB4 are rated for operation at a slightly higher level than the secondary winding output voltage, but much lower than the mains voltage. The mains supply voltage level is preferably stepped down to a range which is less than approximately 50% of the mains supply, in order to achieve the maximum benefits of the invention. The bulbs are preferably derated by approximately 70% to 95% in order to achieve the maximum benefits of the invention. As examples, using commonly available lamps: lamps rated at 7 volts may be operated at 6 volts; lamps rated at 14 volts may be operated at 12 volts; and, lamps rated at 28 volts may be operated at 24 volts. Lamps rated at 28 volts and operated at 24 volts are illustrated in the drawings. In accordance with another aspect of the invention, the indicator lamps are wedge based lamps. The assembly 130 can be mounted in a number of convenient locations, either centrally; or, at, in or adjacent the local call button boxes or elevator control panel. Accordingly, the invention is applicable for new installations as well as retrofit installations.

Figure 7:
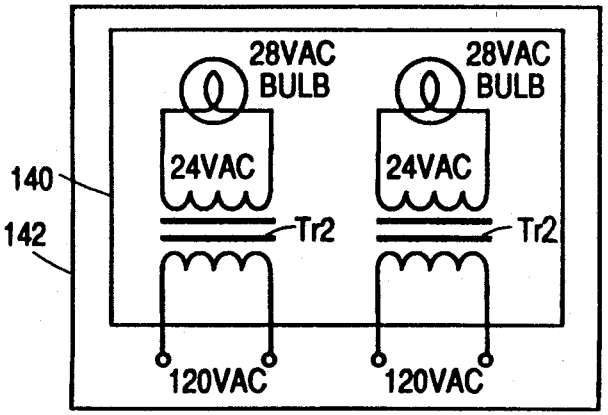
FIG. 7 illustrates part of an alternative circuit for energizing each lamp by a separate transformer.

An alternative circuit is shown in FIG. 7, wherein an assembly 140 comprises two transformers Tr2, each of which steps down the 120 volt AC level of each of two control signals, for example CS1 and CS2, to 24 volts AC. Each bulb is also rated at 28 volts AC. One such transformer is provided for each indicator lamp. The additional transformers Tr2 can be mounted in the same manner as the assemblies 130. Alternatively, particularly for new installations, assembly 140 is preferred, with the additional transformers conveniently located in the same electrical box 142, space permitting, as the respective call button/annunciator lamps.

Other components, particularly solid state switching devices, can be used in place of the relays and transformers shown in the drawings in FIGS. 6 and 7, provided such devices can offer a similar function. In FIG. 6, for example, triacs, silicon controlled rectifiers, gate turn on devices, SIDACs or other thyristors can replace the four relays, eliminating the need for the common relay connection on the AC mains side. Transformer Tr1 can be replaced by conduction angle control circuitry, for example, numerous examples of which are described in the literature, such as Thyristor Device Data published by Motorola as publication number DL137, 1985, incorporated herein by reference. The devices can output identical trigger pulses to the thyristors. The common from the lamps is bypassed, being directly connected to the 120 VAC common input. Due to the extremely short duration of the higher than lamp rated voltage portion of the conduction angle and the comparatively long delay angle, which is non-conductive, of the thyristors, a low voltage mains supply can be simulated. Such solid state devices offer the advantages of requiring less space, weighing less and being far more reliable than conventional components. These advantages must be weighed against the damage to the lamp filaments, for example notching and crystalization, which might occur due to the large transient current surges typical of the switching characteristics of such devices.

Figure 8:
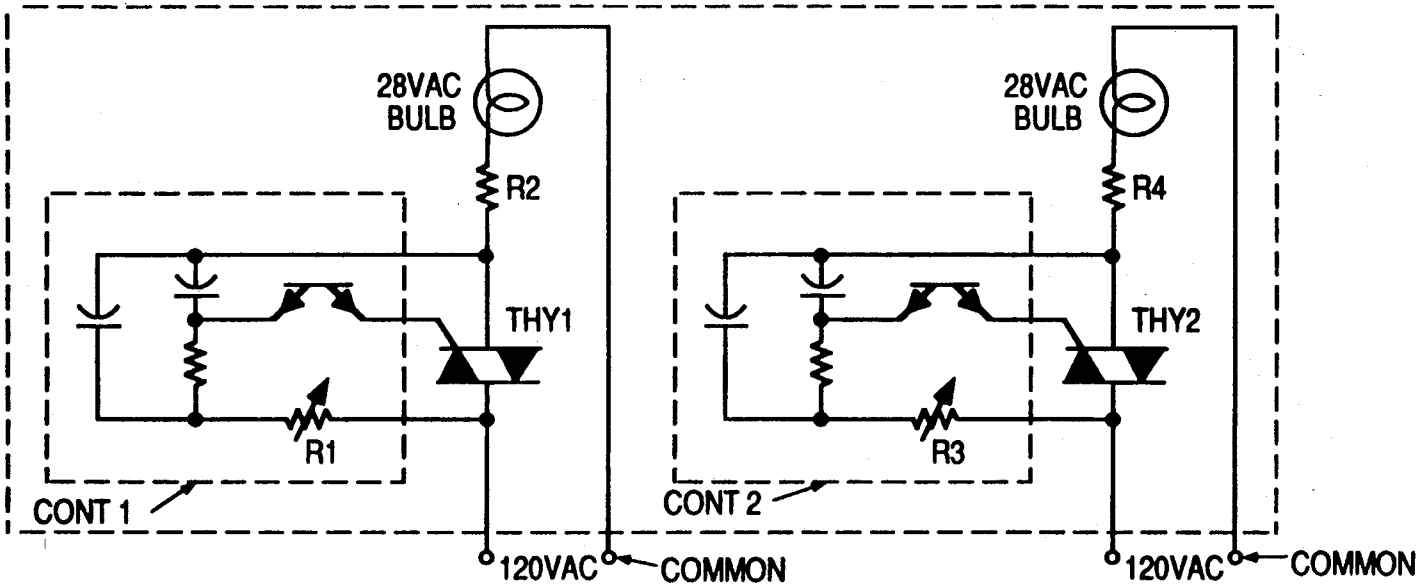
FIG. 8 illustrates part of an alternative circuit for energizing each lamp by a solid state switching device.

An illustrative circuit using solid state devices is shown in FIG. 8. Each of the lamps or bulbs is connected to the AC mains voltage through one of thyristors THY1 and THY2. Conduction angle control circuits CONT1 and CONT2 are set to attain a comparatively small conduction angle. Variable resistors VR1 can be adjusted to control the brightness versus operational lifetime characteristic by changing the size of the conduction angle. The greater the conduction angle, the higher the voltage driving the bulbs, and vice versa. A smaller conduction angle corresponds to a transformer having a larger step down ratio. Resistors R2 may be optionally provided in series with the lamps to reduce the driving voltage to the lamps, permitting a larger conduction angle. This can reduce notching effects, while reducing heat dissipation in the conduction angle control circuits. A single resistor, not shown, having a higher wattage rating than resistors R2 can be used in place of individual resistors R2, being connected on the common side of the lamps in a common return line. Individual resistors can also be variable resistors, to control the brightness versus operational lifetime characteristic. The actual number and location of the conduction angle control circuits will depend upon the specific type of solid state device and the selected triggering method. Some triac drivers, for example, require a low voltage DC power source. The circuit of FIG. 8 is not intended to be a comprehensive description of solid state switching, but an illustration that such devices are within the scope of the invention.

Use of lower than mains supply voltage rated wedge based lamps, at a further derated voltage level, is expected to increase the operational lifetime of the lamps now utilized, from a range of 8–12 months to a range of 3–5 years. The cost savings in the initial cost of the bulbs and the reduced number of service calls is expected to much more than compensate for the additional cost of purchasing and installing the assemblies 130 or the individual transformers Tr2.

The invention is not limited to the precise arrangements and instrumentalities shown in the drawings and described above. Reference should be made to the appended claims, rather than the foregoing specification, as indicating the scope of the invention.

What is claimed is:

1. An electrical circuit for an elevator system, comprising:

a call button/annunciator assembly having a button and a lamp;

a transformer for stepping down an AC mains voltge level from an AC mains supply for developing an output voltage at a first level; and, switch means coupled to said lamp and to said transformer and responsive to a signal from said button at said AC mains voltage level for energizing said lamp at said stepped down first level.

2. A circuit according to claim 1, wherein said switch means is electromechanical.

3. A circuit according to claim 2, wherein said switch means comprises a relay.

4. A circuit according to claim 1, wherein said first level is less than approximately 50% of said AC mains supply voltage level.

5. A circuit according to claim 1, wherein said lamp has an operational voltage rating and said first level is in a range of approximately 70% to 95% of said voltage rating.

6. A circuit according to claim 4, wherein said lamp has an operational voltage rating and said first level is in a range of approximately 70% to 95% of said voltage rating.

7. A circuit according to claim 1, wherein said lamp comprises a T-3¼ wedge-based lamp having a rated operating voltage of approximately 28 volts and said first level is approximately 24 volts.

8. An elevator call button/annunciator assembly and control system, comprising:

an electrical box;

at least one call button assembly mounted in said box;

an indicator lamp mounted in said box;

a transformer for stepping down voltage from an AC mains supply voltage level to a lower voltage level for driving said indicator lamp;

a relay having contacts coupled for supplying said lower voltage level to said lamp and a having coil for actuating said contacts; and, a central controller coupled to said coil and to said at least one push button assembly, and responsive to a button-actuated signal at said AC mains supply voltage level, for energizing said lamp at said lower voltage level.

9. The assembly and control system of claim 8, wherein said lower level is less than approximately 50% of said AC mains supply voltage level.

10. The assembly and control system of claim 8, wherein said lamp has an operational voltage rating and said lower level is in a range of approximately 70% to 95% of said voltage rating.

11. The assembly and control system of claim 8, wherein said lamp is rated for operation at a voltage level higher than said stepped down lower level.

12. An electrical circuit for an elevator call button-/annunciator assembly, comprising:

a solid state switching device operable in a range of phase angles;

means for controlling said phase angle of said device for stepping down an AC mains voltage level from an AC mains supply for developing an output voltage at a first level; and, a call button/annunciator assembly having a lamp coupled to said switching device and having a button, said switching device being responsive to a signal from said button at said AC mains voltage level, for energizing said lamp at said first level.

13. A circuit according to claim 12, wherein said first level is less than approximately 50% of said AC mains supply voltage level.

14. A circuit according to claim 12, wherein said lamp has an operational voltage rating and said first level is in a range of approximately 70% to 95% of said voltage rating.

15. A circuit according to claim 13, wherein said lamp has an operational voltage rating and said first level is in a range of approximately 70% to 95% of said voltage rating.

16. A circuit according to claim 12, wherein said lamp comprises a T-3¼ wedge-based lamp having a rated operating voltage of approximately 28 volts and said output voltage level is approximately 24 volts.

* * * * *